United States Patent [19]

Imatt

[11] 4,147,361

[45] Apr. 3, 1979

[54] GAME APPARATUS

[75] Inventor: Alex Imatt, Chicago, Ill.

[73] Assignee: Marvin Glass & Associates, Chicago, Ill.

[21] Appl. No.: 872,550

[22] Filed: Jan. 26, 1978

[51] Int. Cl.[2] ..... A63F 3/00

[52] U.S. Cl. ..... 273/271

[58] Field of Search ..... 273/264, 267, 271, 294

[56] References Cited

U.S. PATENT DOCUMENTS

| | | | |
|---|---|---|---|
| 2,901,255 | 8/1959 | Sutherland | 273/267 |

FOREIGN PATENT DOCUMENTS

| | | | |
|---|---|---|---|
| 715927 | 8/1965 | Canada | 273/267 |
| 6612118 | 3/1968 | Netherlands | 273/267 |
| 1114268 | 5/1968 | United Kingdom | 273/271 |
| 1321071 | 6/1973 | United Kingdom | 273/267 |

*Primary Examiner*—Harland S. Skogquist

*Attorney, Agent, or Firm*—Mason, Kolehmainen, Rathburn & Wyss

[57] ABSTRACT

A novel game apparatus developed as a variation of a tic-tac-toe theme employs a base having multiple sets of three-dimensional, diamond shaped matrices and two different types of playing pieces. Each playing piece has a pair of different symbols such as an "X" and "O" on an upper surface and the pieces are played by placement over pairs of playing spaces on the matrices. Each matrix may be color coded to distinguish from adjacent matrices. One type of playing piece is diamond shaped and is adapted for placement only within the boundaries of a single matrix. The other type of playing piece is angle shaped and is adapted for placement only across a boundary line between adjacent matrices. The "X" and "O" symbol of the playing piece is adapted to cover a pair of play spaces on the base. The player to complete the greatest number of rows of three of the same symbols wins the game.

13 Claims, 3 Drawing Figures

GAME APPARATUS

BACKGROUND OF THE INVENTION

1. Field of the Invention

The present invention relates to a game apparatus developed as a variation of a tic-tac-toe game wherein a plurality of tic-tac-toe matrices are arranged for play and two different types of playing pieces are placed over spaces of the matrices. One type of playing piece is diamond shaped and the other is angle shaped and each type includes a pair of different symbols thereon such as "X" and "O" for covering over the playing spaces on the matrices. The angular playing pieces are adapted for placement across boundry lines between adjacent matrices and may be positioned in a pair of alternate positions with the symbols "X" or "O" in different matrices. The diamond shaped playing pieces are utilized only within a single matrix and cannot be used across dividing lines between different matrices. The game is played in typical tic-tac-toe fashion with each player attempting to place three like symbols in a line and the winner is the player who succeeds in completing the greatest number of lines on the matrices provided.

2. Description of the Prior Art

A variety of different logic games have been developed around the theme of tic-tac-toe games. These games require mental skill rather than physical or manual dexterity and provide an interesting pastime for the players. As far as is known, however, no tic-tac-toe type games have been developed wherein a plurality of diamond shaped matrices are provided with two different types of playing pieces, each including a pair of different symbols such as an "X" and "O" thereon and each type adapted to be placed only in particular locations on the matrices during play while attempting to align three like symbols in a row.

SUMMARY OF THE INVENTION

It is an object and advantage of the present invention to provide a new and improved game apparatus and more particularly to a new and improved game apparatus developed on a variation of a tic-tac-toe theme.

Another object of the present invention is to provide a new and improved tic-tac-toe game wherein a plurality of matrices are provided and two different types of game pieces are utilized for placement on the matrices, each with a pair of symbols such as "X" and "O".

Another object of the present invention is to provide a game of the character described wherein each playing piece can be played in a pair of alternate ways.

Another object of the invention is to provide a new and improved game apparatus of the character described wherein one type of playing piece may be positioned in particular locations only with opposite leg portions of the playing piece extending into matrices on opposite sides of a dividing line between the same.

Another object of the present invention is to provide a new and improved game apparatus of the character described in the preceding paragraph wherein another type of playing piece may be placed only within the confines of a single matrix.

Another object of the present invention is to provide a new and improved game apparatus of the character described wherein a cluster or plurality of sets of several matrices are provided with the object of the game being to successfully align, three like symbols in a row, a maximum number of times during a game.

Still another object of the present invention is to provide a new and improved game apparatus of the character described wherein the playing pieces are snappingly engaged onto play spaces of the matrices and are readily removable when desired.

The foregoing and other objects and advantages of the present invention are accomplished in an illustrated embodiment wherein a base is formed with a playing surface having disposed thereon, a plurality of diamond shaped matrices disposed on opposite sides of dividing lines between the matrices. Each of the matrices includes a plurality of diamond shaped playing spaces with an edge row of play spaces adjacent the dividing line and parallel rows remote therefrom. The matrices also include parallel columns intersecting the dividing lines at acute angles and intersecting one another at the dividing lines between matrices. Two different types of playing pieces are provided for use on the matrices and each of the playing pieces includes a pair of different symbols on the face thereof such as an "X" and "O". A first type of playing piece is diamond shaped and these are adapted to fit over pairs of adjacent play spaces contained within a single one of the matrices. A second type of playing piece is angle shaped and has a pair of diamond shaped legs intersecting along a center line. These second type of playing pieces are only useable when positioned over a dividing line between adjacent matrices wherein the center line of a playing piece is juxtapositioned over the dividing line with the playing spaces on opposite sides of the line covered thereby. The players in turn may select either type of playing pieces and place them on the matrices as described with the object of the game being to obtain as many, three-in-a-row, like symbols as possible.

BRIEF DESCRIPTION OF THE DRAWINGS

For a better understanding of the invention, reference should be had to the following detailed description taken in conjunction with the drawings, in which.

DESCRIPTION OF THE PREFERRED EMBODIMENT

Referring now more particularly to the drawings, therein is illustrated a new and improved game apparatus constructed in accordance with the features of the present invention and developed around a variation of tic-tac-toe. The game apparatus includes a generally circular shaped base or game board 10 preferably formed of molded plastic material and including a generally circular playing surface 12 with a depending, cylindrical skirt 14 around the peripheral edge or circumference thereof for supporting the base on a convenient playing surface such as the floor or card table or the like.

Figure 2:
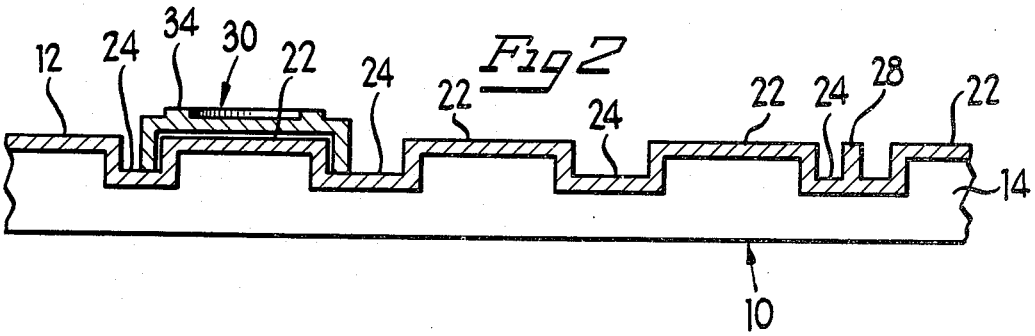
FIG. 2 is a fragmentary, sectional view taken substantially along lines 2—2 of FIG. 1.

In accordance with the present invention, the playing surface 12 of the board is formed with a plurality of groups of diamond shaped matrices 16-1-2-3, 18-1-2-3 and 20-1-2-3 arranged in clusters of three with each cluster having an inside matrix adjacent the inside matrices of the other two clusters. Each of the matrices is identical in shape and includes a plurality of diamond shaped play spaces 22 arranged in parallel rows and angularly transverse parallel columns of three spaces each as shown. Referring to FIG. 2, the diamond shaped upper surface of each playing space 22 is coplanar with the surrounding outer playing surface 12 of the board and between each row and column and along the outside edges of each matrix indented recess areas 24 are formed below the level of the playing surface 12. Accordingly, a peripheral recess is provided along the outer edges of each play space in each of the respective matrices.

Figure 1:
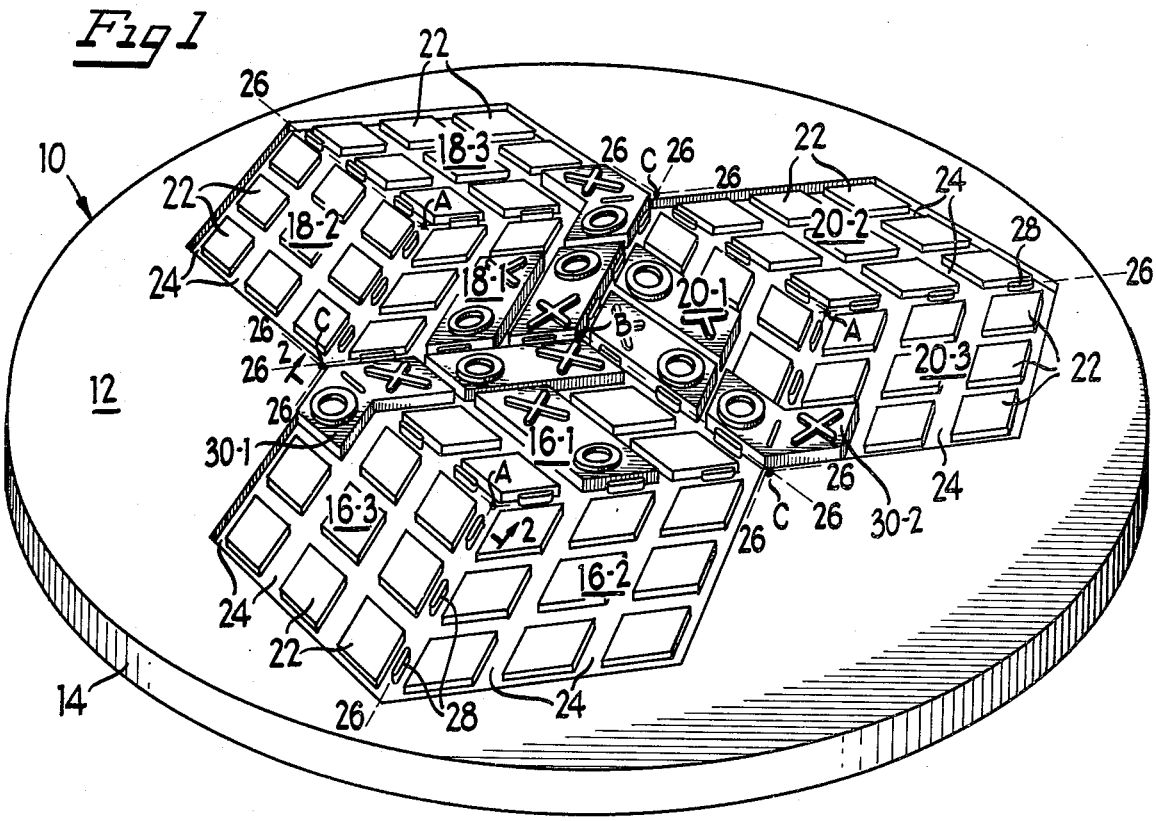
FIG. 1 is a perspective view illustrating a novel game apparatus in accordance with the features of the present invention.

Within each cluster of matrices 16, 18 and 20, each single matrix is positioned adjacent the other two matrices of the cluster and dividing lines 26 separate adjacent edge rows or columns of playing spaces 22 between pairs of matrices on opposite sides of the lines. As an example, in the matrices 16-1, 16-2 and 16-3, of one cluster (shown in the lower portion of FIG. 1), each matrix includes an edge row or column disposed adjacent one of three matrix dividing lines 26 and the lines intersect at a common point "A" at the center of the cluster. The inside pair of dividing lines 26 also serve as "cluster" dividing lines for separating the matrices 16-1, 18-1 and 20-1 of the three different clusters and these lines intersect at the center of the game board surface 12 at a point "B", as shown in FIG. 1. These inside cluster dividing lines also intersect a pair of outer dividing lines at points "C" at the edges of adjoining clusters.

Because of the diamond shape of the playing spaces 22, each of the rows and columns in each matrix intersects a pair of intersecting dividing lines 26 adjacent thereto at an acute angle and the rows of playing spaces in one matrix intersect the rows of an adjacent matrix along one of the dividing lines 26 with the columns of the one matrix intersecting the columns of a third other matrix of the cluster along a second dividing line 26 therebetween.

Figure 3:
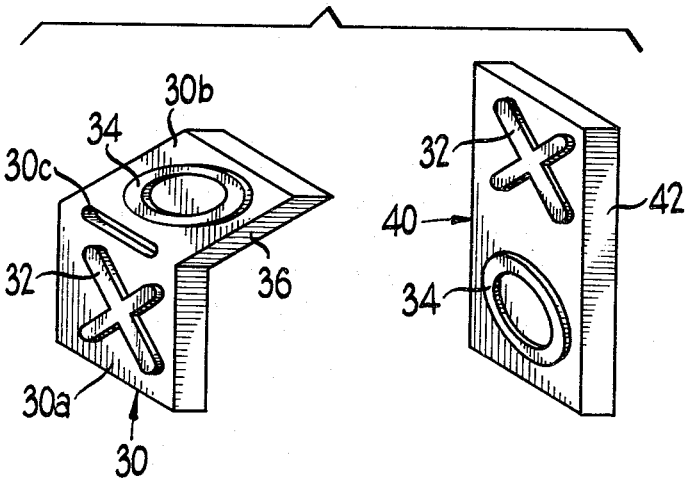
FIG. 3 is a perspective view illustrating each of two different types of game pieces constructed in accordance with the present invention.

In accordance with the present invention, the game apparatus includes two different types of playing pieces as best shown in FIG. 3, and represented by the reference numerals 30 and 40 respectively. Each type of playing piece is adapted to be placed over one pair of diamond shaped play spaces 22 in covering relation as shown in FIGS. 1 and 2 during play. Each piece includes an upper surface having a pair of different symbols spaced apart thereon such as an "X" 32 and an "O" 34 and each symbol is positioned so as to be centered above one of the play spaces of the matrices when the playing piece is played. The angular playing pieces include a pair of diamond shaped legs **30*a* and 30*b* and the legs intersect along a center line having an elongated slot 30*c* provided therein. Whenever an angle playing piece 30 is placed on the game board in an edge row or edge column across a dividing line 26, the slot 30*c* is adapted to accommodate an upstanding projection 28 formed on the line between the ends of the pairs of intersecting rows or columns. Engagement of the matrix line projections 28 into the slots 30*c* helps to retain the angle playing pieces 30 in position once they have been played on the board 10 and a piece may be positioned in one of two alternate positions depending upon which of the dividing lines 26 the play piece is mounted to extend across. In addition, two types of angle playing pieces 30 are provided and one type (30-1) has the "X" and "O" symbols in an order that is reversed with respect to the other type (30-2). Either type angle playing piece 30 can only be played along the dividing lines 26 and when so played, the opposite legs 30*a* and 30*b* extend into and over pairs of playing spaces located in different matrices either in the same cluster or in different clusters. The angle playing pieces 30 also include downwardly extending peripheral skirts 36 which bottom against the upper surfaces of the game board recesses 24 and help to snap into place and hold the playing pieces in position as shown in FIG. 2**.

The diamond shaped playing pieces 40 also include a depending peripheral skirt 42 for a similar purpose and these playing pieces may only be played within the confines of a single matrix and cannot be positioned to extend across any of the dividing lines 26. Each diamond playing piece 40 may be reversed so that the relative positions of the symbols "32" and "34" may change.

Because of the angular divergence between the intersecting rows and the columns of the respective matrices across the dividing lines 26, a successful score for a three-in-a-row line of like types of symbols, either "X" or "O", can only be counted when the line of three is formed within the confines of a single matrix.

Preferably, each matrix on the board 10 is of a particular color different from that of other matrices and each player continues in rotation, playing a game piece each turn until all of the playing spaces 22 on the respective matrices have been covered or until a selected number of successful tic-tac-toe, three-in-a-row lines have been achieved. The game thus provides mental stimulation and helps a player with developing visual orientation. Moreover, the expanded tic-tac-toe game is interestingly complex to play and more than two players can be involved in a game if desired.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. Game apparatus comprising:

a base having a plurality of diamond shaped matrices defined on a playing surface disposed on opposite sides of a dividing line between adjacent matrices, each of said matrices including a plurality of diamond shaped play spaces with an edge row of play spaces adjacent said line and a parallel row remote therefrom, said matrices including parallel columns intersecting said dividing line at an acute angle and the columns of the matrices on opposite sides of said dividing line angularly intersecting one another at said line;

a plurality of diamond shaped playing pieces adapted to fit over a pair of adjacent play spaces in either of said matrices and including a pair of different symbols thereon, each symbol adapted to be positioned over one of said adjacent play spaces; and a plurality of angle shaped playing pieces having a pair of diamond shaped legs intersecting along a center line with a different one of said symbols on each leg, said angle shaped playing pieces adapted to be placed over a pair of playing spaces in different matrices on opposite sides of said dividing line with the center line thereof on said dividing line.

2. The game apparatus of claim 1 including means for removable interlocking attachment between said playing spaces of said base and said playing pieces.

3. The game apparatus of claim 2 wherein said interlocking attachment means includes recess and projection means on said playing pieces and said playing spaces adapted to receive projection means for maintaining said interlocking attachment.

4. The game apparatus of claim 3 wherein said recess means comprises a plurality of recesses having a diamond shaped outline.

5. The game apparatus of claim 2 wherein said interlocking attachment includes a plurality of elongated interlocking recesses and projections on said angular shaped playing pieces and said base along said dividing line and center lines.

6. The game apparatus of claim 1 wherein said base includes at least three of said diamond shaped matrices in a cluster with each matrix separated from the other pair of matrices by a pair of said dividing lines, all of said dividing lines angularly intersecting at a common center point of said cluster.

7. The game apparatus of claim 6 wherein said base includes a plurality of said clusters, said clusters separated by a cluster dividing line along adjacent matrices of different clusters.

8. The game apparatus of claim 7 wherein said base includes at least three of said clusters with each cluster separated from the other pair of clusters by a pair of said cluster dividing lines, all of said cluster dividing lines angularly intersecting at a common center point of the group of three clusters.

9. The game apparatus of claim 7 wherein said angle shaped playing pieces are adapted to be placed over a pair of playing spaces in different clusters of said matrices on opposite sides of said cluster dividing line with the center thereof on said cluster dividing line.

10. The game apparatus of claim 1 wherein said different symbols on each playing piece comprise a letter X and a letter O for use in aligning the same symbol in line extending between three of said playing pieces placed on the playing spaces in a single matrix.

11. The game apparatus of claim 2 wherein said base is formed with an upper playing surface with said playing spaces coextensive therewith and recesses formed along the edges of each playing space for receiving a projection from said playing pieces placed thereon.

12. The game apparatus of claim 11 wherein each of said playing pieces includes an upper surface with said symbols thereon and a depending peripheral skirt adapted to project downwardly into said recesses along the edges of said playing spaces on which said playing pieces are placed.

13. The game apparatus of claim 11 wherein recesses along said playing spaces of said edge rows form a continuous groove along said line between said matrices, a plurality of spaced apart projections in said groove, said angle shaped playing pieces adapted to span said groove between playing spaces on opposite sides and including a slot along the center line for receiving a projection in the groove.

* * * * *